United States Patent [19]

Kuhl

[11] Patent Number: 4,911,439

[45] Date of Patent: Mar. 27, 1990

[54] BODY SUPPORTED RESILIENT EXERCISE APPARATUS

[76] Inventor: Larry L. Kuhl, 1925 S. Carolina Ter., Mason City, Iowa 50401

[21] Appl. No.: 307,061

[22] Filed: Feb. 7, 1989

[51] Int. Cl.[4] ..... A63B 21/02

[52] U.S. Cl. ..... 272/139; 272/143

[58] Field of Search ..... 272/93, 135, 119, 137, 272/139, 142, 116, 143

[56] References Cited

U.S. PATENT DOCUMENTS

| | | | |
|---|---|---|---|
| 1,663,641 | 3/1928 | Smallwood | 272/139 |
| 2,224,103 | 12/1940 | Nilson | 272/142 X |
| 4,026,549 | 5/1977 | Gunn | 272/137 X |
| 4,040,620 | 8/1977 | Friedman | 272/137 |
| 4,090,706 | 5/1978 | Reda | 272/137 |
| 4,251,071 | 2/1981 | Norton | 272/137 |
| 4,284,274 | 8/1981 | Boothe | 272/116 |
| 4,478,414 | 10/1984 | Molloy | 272/142 X |
| 4,540,173 | 9/1985 | Hopkins, Jr. | 272/139 |

FOREIGN PATENT DOCUMENTS

| | | | |
|---|---|---|---|
| 562787 | 10/1932 | Fed. Rep. of Germany | 272/142 |
| 451516 | 8/1936 | United Kingdom | 272/137 |

OTHER PUBLICATIONS

Speed Shaper; Washington Post; 7/1983.

*Primary Examiner*—Richard J. Apley
*Assistant Examiner*—H. Flaxman
*Attorney, Agent, or Firm*—Kent A. Herink

[57] ABSTRACT

An exercise device for use by a person. An elastic cord is formed into a generally figure eight shape including two loops that are coincident at a common juncture. The two loops may be releasably interconnected at points generally diametrically opposite the common juncture. A plurality of tubular handles are received about sections of the elastic cord. In use, the person wears the device as a harness with the common juncture forming a back yoke and each of the loops encircles an arm and shoulder and are releasably connected at the front center waistline of the person. Exercises are performed by grasping the handles and extending the elastic cord.

5 Claims, 2 Drawing Sheets

BODY SUPPORTED RESILIENT EXERCISE APPARATUS

BACKGROUND OF THE INVENTION

This invention relates to an exercise apparatus and, more specifically, to a harness worn by a person and used to facilitate a plurality of exercises.

The public interest in physical fitness and health has been on the rise in recent years. In particular, aerobic activities such as running, jogging and walking have become increasingly popular and are widely recommended by physicians and others in the health professions for the benefits derived therefrom in the areas of weight control, improved aerobic capacity, increased bone density, lowering of serum cholesterol and low density lipoproteins, and the like. Increasingly, however, it is being recognized that muscular and skeletal imbalances can result if only certain of the body's muscles are used heavily while the others remain unexercised. Further, without regard to other forms of exercise, activity involving movement against resistance and through a wide range of motion will also improve muscle tone, flexibility and strength.

Prior art devices for exercising the upper body adaptable for use during aerobic exercise include U.S. Pat. Nos. 3,999,752 and 1,432,013. The '752 patent teaches a pair of flexible cords that are anchored to a waistband by a pair of pulleys. The flexible cords have handles at their terminal ends which are grasped by the person wearing the device. Exercise is achieved by movement of the person's limbs against the resistance of the flexible cords. In the '013 patent, a pair of flexible cords with intermediate handles are attached to a waistband and yoke at the rear of a person wearing the device. Again, exercise is accomplished by movement of the wearer's arms against the resistance of the cords. Neither prior art device provides for exercise against resistance along a vector other than one originating at the waist of the wearer.

SUMMARY OF THE INVENTION

The invention consists of an exercise device for use by a person wearing the device. The device is made of a length of elastic cord that is formed into a generally figure eight shape including two loops having common juncture. Ties or other suitable means are used to join the two loops together for a short length near the common juncture. Each of the two loops, at a point generally diametrically opposite the common juncture, is provided with an interconnecting hook and loop or other suitable means for releasably connecting the loops together. At least two pair of tubular handles are received about the cord, one pair on either side of the releasable connection of each of the loops.

In use, the common juncture forms a yoke at the back of the wearer. From the yoke, one part of each loop passes over a shoulder of the wearer. The other part leads from the yoke around the waist of the wearer. The two loops are interconnected at the hook and loop connection means which will be located at the front center waistline of the wearer. The handles are grasped by the wearer who can then exercise against the resistance of the elastic cord by extension of the wearer's arms in virtually any direction.

DETAILED DESCRIPTION OF A PREFERRED EMBODIMENT

Figure 1:
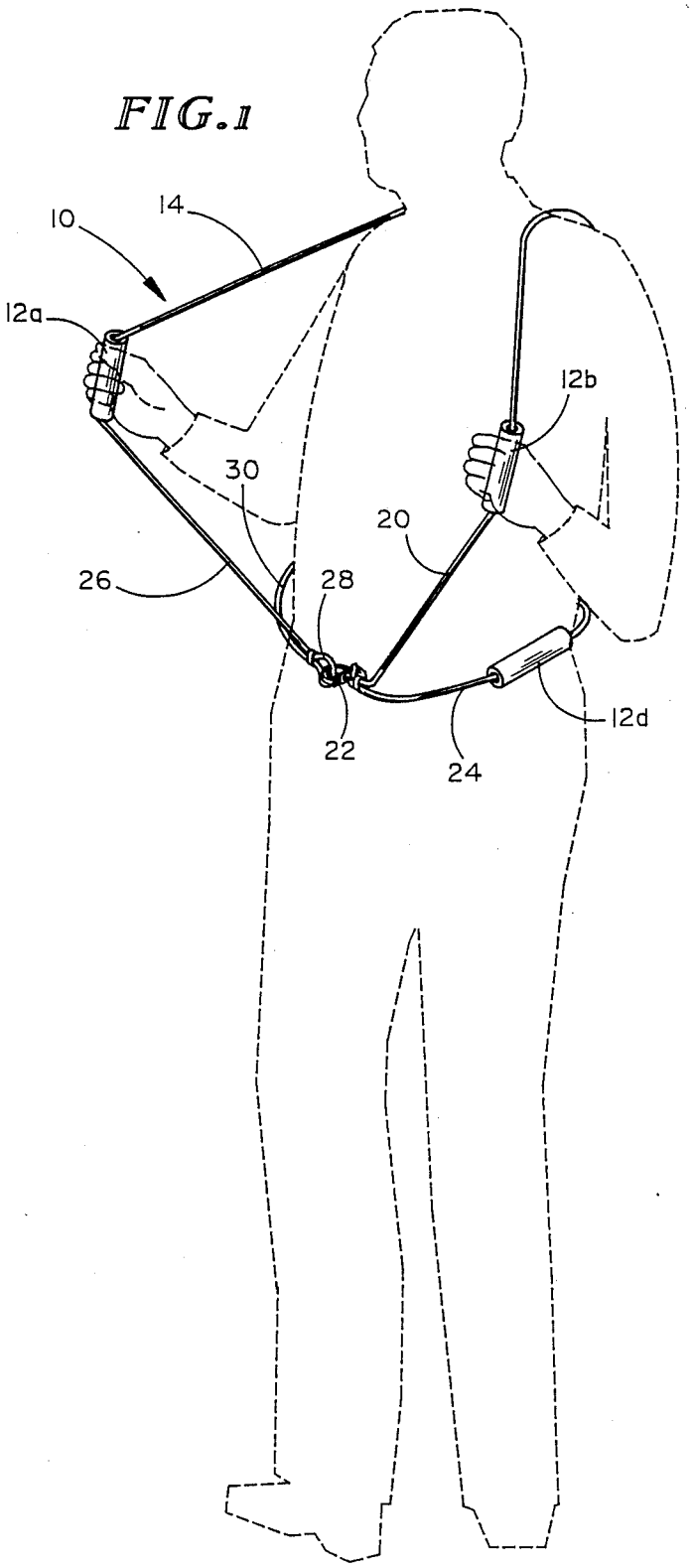
FIG. 1 is a perspective view of the exercise harness in use by a person shown in broken line.

In FIG. 1, generally at 10, is illustrated an exercise harness of the present invention being used by a person (shown in broken line). The person is grasping a pair of handles 12*a* and 12*b* which are received about a length of elastic cord 14 which serves as the principal constituent of the exercise harness 10. By extending his arms, the person stretches the elastic cord 14 doing work or exercise in the process.

Figure 2:
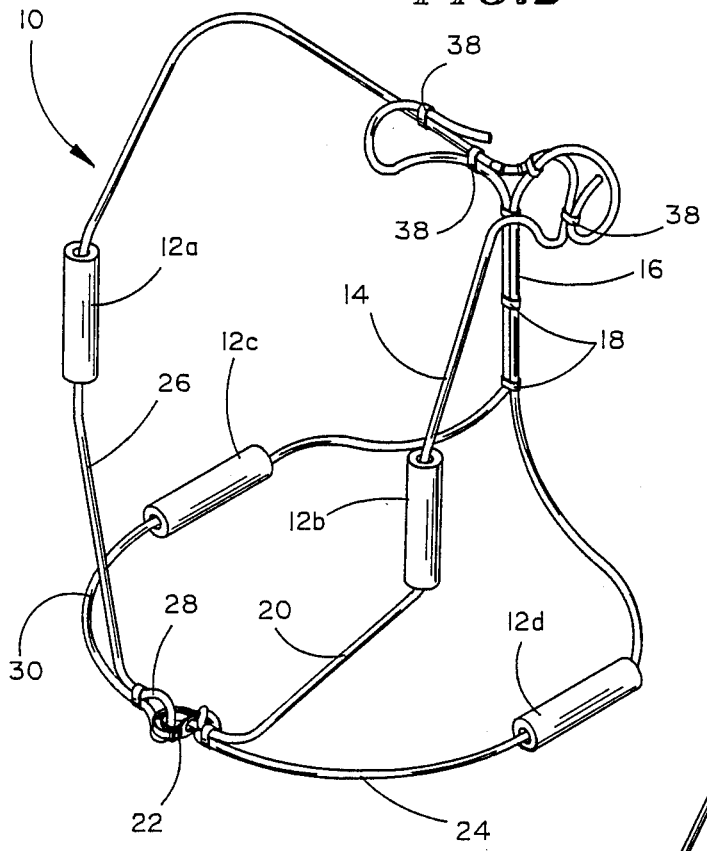
FIG. 2 is a perspective view of the harness.

The exercise harness 10 is best described topologically as a pair of loops made of a single length of elastic cord 14 to form a generally figure eight shape. The common juncture of the figure eight is illustrated in FIG. 2 at 16. The two loops of the exercise harness 10 are joined together along a small length of the common juncture by a plurality of ties 18 or other suitable means.

One of the pairs of loops of the exercise harness 10 consists of a section 20 of elastic cord 14 that extends from the top of the common junction 16 forwardly to a releasable hook 22. The loop is completed by a section 24 of elastic cord 14 that extends from the releasable hook 22 back to the lower end of the common juncture 16. In a similar manner, the other loop of the exercise harness 10 includes a section 26 that extends from the upper part of the common juncture 16 over to a small loop 28 an a section 30 that extends from the small loop 28 back to the lower portion of the common juncture 16.

Figure 3:
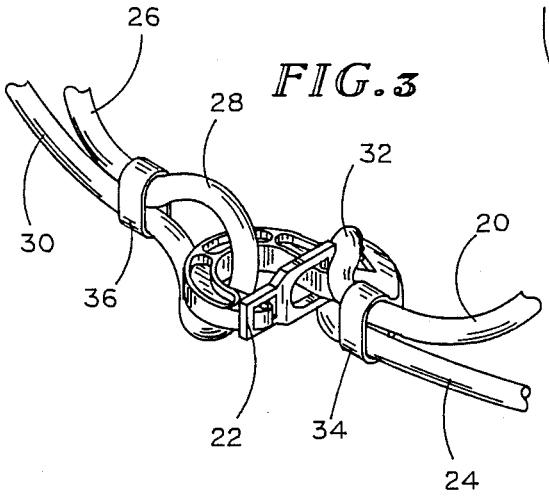
FIG. 3 is an enlarged view showing the coacting hook and loop.

The releasable hook 22 is attached to the sections 20 and 24 by means of a capture loop 32 formed by a slide tie 34 that encircles both the section 20 and the section 24. The small loop 28 is similarly formed by a slide tie 6 that encircles both the section 26 and section 30. As best illustrated in FIG. 3, the releasable hook 22 can be interconnected with the loop 28 to releasably join the two larger loops of the exercise harness 10 (FIG. 2).

Referring again to FIG. 2, a plurality of ties 38 are used to attach the free ends of the elastic cord 14 to the loops of the exercise harness 10 and to provide for a means of adjusting the size of the loops to fit users of different sizes.

Figure 5:
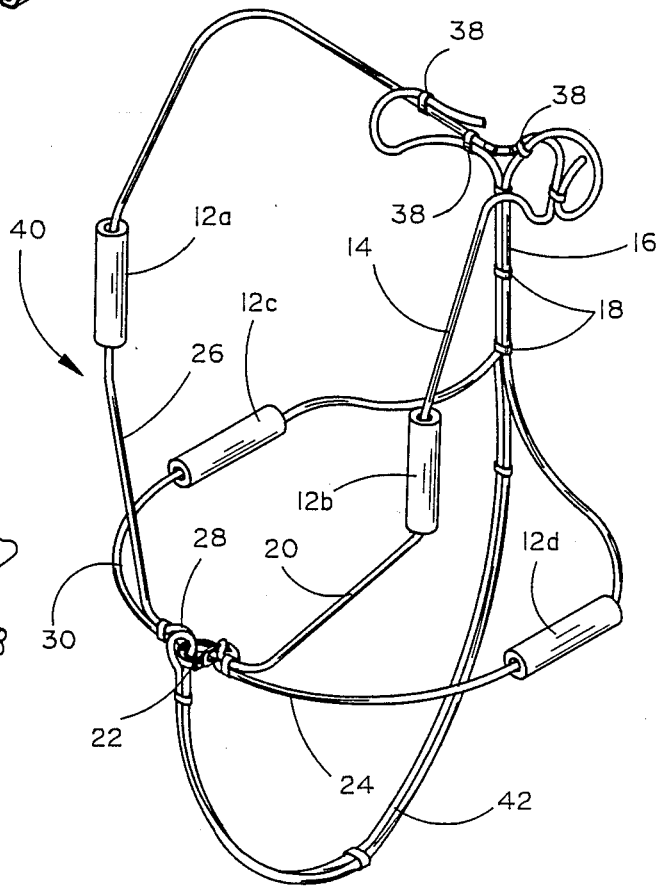
FIG. 5 is a perspective view of a harness wherein an additional length of cord has been added to pass between the legs of the wearer.

A second embodiment of the invention is illustrated in FIG. 5, generally at 40. This harness 40 is similar in all respects to the exercise harness 10 except that an additional section 42 of elastic cord has been added. The added section 42 extends from the bottom of the common juncture 16 to its releasable attachment with the interconnecting hook 22. In use, the additional section 42 would pass from the back of the wearer through the legs and be anchored also at the front center at waist level. The additional section 42 would thereby act to hold the harness to prevent it from rising above the preferred waist level of the user during exercises which pull upwardly on the harness 40.

Figure 4:
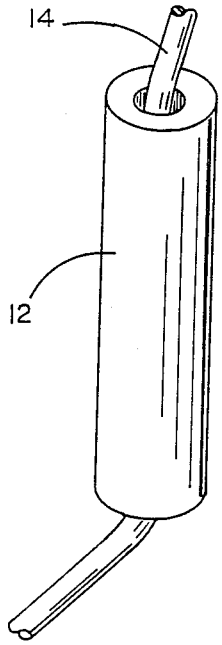
FIG. 4 is an enlarged view of a handle.

As discussed above, a pair of tubular handles 12*a* and 12*b* are received about the sections 26 and 20, respectively, of the elastic cord 14. Similarly, a second pair of tubular handles 12*c* and 12*d* are received about the sections 30 and 24, respectively. A representative tubular handle 12 is illustrated in FIG. 4. The handles 12 are tubular with an inside diameter larger than the elastic cord 14 such that each handle 12 can slide along its respective section of elastic cord 14. The handles 12 are made of a resilient material that can be crushed or compressed by the hand of a user to releasably grip the elastic cord 14 that passes through the handle 12. Accordingly, the handles 12 can be slidably moved along the respective sections of the elastic cord 14 to position them at any convenient location there along. Once the handles 12 have been placed in the desired position, the handles 12 can be compressed to grip the elastic cord 14 so that they are no longer slidably movable and instead ac as stationary handles to assist in the performance of exercises using the exercise harness 10 and 40. The elastic cord 14 can be of any suitable elastic material that provides an appropriate amount of resistance to stretching. It can be envisioned that harnesses of adjustable resistance could easily be made by using elastic cord 14 of selected resistance to extension.

A wide variety of exercises can be performed using the harnesses 10 and 40. Moreover, because the harnesses 10 and 40 are extremely lightweight and do not interfere with activities such as running, jogging, and walking, the harnesses 10 and 40 can be used to exercise the upper body of a person while engaging in these or other aerobic activities. If desired, more than two pairs of handles could be attached to the harnesses 10 and 40 either to pad areas of the elastic cord 14 or to serve as additional handles to be used for exercising.

I claim:

1. An exercise device for use by a person, comprising:

(a) a length of elastic cord;

(b) a pair of loops formed of said cord in a generally figure eight shape including a common junction where said loop meet;

(c) means for joining said loops at their common juncture;

(d) coacting means on each of said loops for releasably connecting said loops together at a point on each loop generally diametrically opposite the common juncture;

(e) at least two tubular handles received about said cord; and (f) when the device is used by a person, said common juncture is at the back and said loops pass over the shoulders of the person to said releasable connection at the front waist of the person and from said connecting means back to the common juncture.

2. The device as defined in claim 1, wherein:

(a) said coacting means are a pair of interconnecting hooks.

3. The device a defined in claim 1, wherein:

(a) the circumference of each of said loops is adjustable; and (b) the position of said coacting means is adjustable.

4. The device as defined in claim 1, wherein:

(a) one of said pair of handles is located on a section of each of said loops from said coacting means around to said common juncture; and (b) one of said pair of handles is located on a section of each of said loops from said common juncture over the shoulders of the person to said coating means.

5. The device as defined in claim 1, wherein:

(a) said handles are crushable to permit the person to grip said cord passing therethrough.

* * * * *